US006755420B2

(12) United States Patent
Colton

(10) Patent No.: US 6,755,420 B2
(45) Date of Patent: Jun. 29, 2004

(54) CASINO STYLE GAME

(76) Inventor: Roland C. Colton, 445 Marine View Ave., #105, Del Mar, CA (US) 92014

( * ) Notice: Subject to any disclaimer, the term of this patent is extended or adjusted under 35 U.S.C. 154(b) by 309 days.

(21) Appl. No.: 09/967,510

(22) Filed: Sep. 28, 2001

(65) Prior Publication Data

US 2003/0067116 A1 Apr. 10, 2003

(51) Int. Cl.[7] ..... A63F 7/06; A63F 3/00

(52) U.S. Cl. ..... 273/274; 273/146; 273/259; 273/244; 463/16

(58) Field of Search ..... 273/274, 259, 273/244, 244.1, 244.2, 243, 146, 298, 138.1; 463/16, 22, 17

(56) References Cited

U.S. PATENT DOCUMENTS

| | | | | |
|---|---|---|---|---|
| 1,320,315 A | | 10/1919 | Clarke | |
| 4,252,321 A | * | 2/1981 | Hopwood | 273/247 |
| 5,039,107 A | * | 8/1991 | Jackson | 273/237 |
| 5,308,081 A | | 5/1994 | Bartle | |
| 5,415,412 A | | 5/1995 | McMahon | |
| 5,505,457 A | | 4/1996 | Boylan et al. | |
| 5,769,714 A | | 6/1998 | Wiener et al. | |
| 6,419,230 B1 | | 7/2002 | Cass | |

* cited by examiner

*Primary Examiner*—Jessica Harrison
(74) *Attorney, Agent, or Firm*—Rob L. Phillips; Quirk & Tratos

(57) ABSTRACT

The present invention is a dice game based on the sport of baseball. The game described permits a player to participate by wagering on the combined sum of three rolled dice. Each combined sum of the dice equates to a common baseball outcome such as a home run, error or strikeout. Players make wagers dependent on each at-bat, each half-inning or game result. The game played with three dice follows realistically the outcomes associated with a professional baseball game. The game is designed for player v. player, team v. player or team v. team. In the preferred embodiment the game is played on a table including a pit area similar to a craps table. The table layout displays the outcomes, various odds associated with the various wagers and sections for players to place their wagers. The table design also permits dealers, stickmen and/or croupiers to orchestrate the game.

62 Claims, 3 Drawing Sheets

CASINO STYLE GAME

FIELD OF INVENTION

The present invention relates generally to the field of wagering style casino games. More particularly, this invention relates to a dice game and betting layout designed to simulate a baseball game.

DESCRIPTION OF THE PRIOR ART

Since its inception some 150 years ago, baseball has been considered America's Pastime. Fans flock to baseball games during the spring and summer months to relax and escape everyday worries. More recently, professional baseball games have become popular with the gambling public. While not generating the gambling take of professional football games, the gambling take on baseball games continues to increase.

The traditional sports book located in nearly every Las Vegas casino are routinely packed with sports enthusiasts cheering and jeering the performance of a particular team that they have wagered to win. Unfortunately, for the casinos the majority of people visiting Las Vegas desire to play table games such as blackjack, roulette and craps. Therefore, the need exists to combine the action of sports wagering in a table game.

The casinos of the 21$^{st}$ century are proliferated by slot machines which account for a majority of the casinos' revenue. Technology and huge jackpots have increased the popularity of slot machines causing fewer people to play live table games. Casinos are constantly seeking new and exciting table games to level the playing field.

Craps is hands-down the most popular dice game present in any casino. Craps is played with two dice and the game is characterized by betting options and pay outs depicted on a gaming table. In a similar manner, the present invention utilizes three dice on a gaming table depicting betting options and pay outs. The combined total of three dice account for all outcomes associated with a baseball at-bat and afford the most realistic simulation of a professional baseball game.

Patents issued to wagering games continue to rise as the popularity and proliferation of legalized gambling increases. Patents have also attempted to combine sports with table games including the use of dice. However, the wagering games protected by patents have failed to promulgate the casinos.

U.S. Pat. No. 5,769,714 (the '714 Patent) discloses a "Methods and Apparatus For Playing Baseball Gambling Games." The '714 Patent employs a computer processor to dictate the results of each at-bat. The invention protected by the '714 Patent is a video baseball game enhanced by player wagers. Individual players play against other players in an effort to score the most runs in an allotted number of innings. However, there is no significant player participation other than placing bets. Games controlled entirely by computers will not attract the traditional table game player but rather will be more appealing to a slot machine player.

U.S. Pat. No. 1,320,315 (the '315 Patent) discloses a "Game Apparatus" including game pieces such as dice suitable for playing the game of parlor baseball. The dice disclosed in the '315 Patent are typical six-sided dice with various symbols depicted on the dice face. The dice recite "Ball", "Out" and "Hit" corresponding to certain baseball outcomes. The '315 Patent was issued in 1919 and therefore fails to simulate a realistic baseball game of this era. In order to place bets, the wagering public demands a realistic baseball wagering game.

U.S. Pat. No. 5,308,081 (the '081 Patent) discloses a "Method of Playing a Three Dice Betting Game." FIG. 1 of the '081 Patent depicts a gaming table corresponding to a three dice baseball game. Nonetheless, the gaming table fails to treat many traditional baseball outcomes such as the double-play, home run or strikeout. Although, three dice are used, each dice is rolled individually permitting players to place bets on each roll. The game fails to simulate a professional baseball game in any fashion other than to borrow certain obvious baseball terms.

U.S. Pat. No. 5,505,457 (the '457 Patent) discloses a "Method of Playing a Dice Wagering Game Simulating Bowling." The issued patent suggests that the game may provide a basis for a similar game such as baseball. Once again, the '457 Patent discloses a simple game incapable of simulating the numerous outcomes present in a professional baseball game.

The present invention overcomes the referenced deficiencies existing in the prior art, namely the lack of realism inherent in the prior art games of chance. The wagering public is knowledgeable of odds and requires that a sports related wagering game simulate as closely as possible the live version of the game. The present invention closely simulates a professional baseball game, more particularly a Major League Baseball® game.

SUMMARY OF THE INVENTION

An object of the present invention is to provide the a realistic simulation of a live Major League Baseball® game.

Another object of the present invention is to provide a gaming table complete with payout information for all baseball outcomes.

Another object of the present invention is to attract wagering sports enthusiasts to a casino table game.

Another object of the present invention is to provide a means for sports bettors to enjoy sports wagers (e.g. Over/Under, Win/Lose, Parlays or Proposition) in a table game environment.

Another object of the present invention is to permit player interaction during play of the wagering game.

Another object of the present invention is to provide accurate odds based on Major League Baseball's® statistics while maintaining an attractive game to both the wagering public and the house.

Another object of the present invention is to provide the casino or operator the ability to select the most popular wagers from an infinite selection of different baseball related wagers.

Another object of the present invention is to provide the casino or operator the ability to select progressive wagers dependent on rare baseball occurrences including, but not limited to, a no-hitter or perfect game.

Another object of the present invention is to provide a gaming table that simulates a baseball park including a baseball diamond with accurate color schemes (e.g. green grass, brown infield dirt, white bases, etc.), foul-poles, scoreboard with inning-by-inning results and chip holding means staggered to depict a stadium seating configuration.

DISCLOSURE OF THE INVENTION

This invention relates to an apparatus and method of playing a wagering game that simulates a Major League Baseball® game. The present invention provides apparatus including a playing surface (cloth, table top or game board) depicting outcomes, betting areas, pay outs associated with each outcome, three dice and game indicia to track the inning, score, base runners, etc. Further embellishments including a lighted scoreboard and game marquis are provided. The playing surface is similar to that associated with the game of craps except the markings are directed to baseball outcomes. The three dice are rolled simultaneously to provide the random results desired in all casino wagering games.

In playing the game termed DICE BASEBALL™ or DIAMOND DICE™ players can form teams to play against other teams, one player can play another individual player or team, or a player can play the house directly. In all scenarios, players place bets in designated areas on the playing surface corresponding to different anticipated baseball outcomes. The players are permitted to wager on at-bat, half-inning, or game results. Each roll of the three dice corresponds to an at-bat. Common dice comprising six sides each side having a different depiction of one to six dots are utilized in the present invention. The summation of the three dice determines the outcome of that particular roll or at-bat.

As with Major League Baseball® the present invention will consist of nine innings with the possibility of extra innings should the game be tied after nine innings have been played. With team play, it is envisioned that players can pass the roll to other team players for each at-bat or one member of the team can roll for each at-bat in a particular half-inning. Individual players will make their own individual wagers throughout the game. The winner of the game will be the team or player with the most runs after nine innings of play.

A Brief Summary of the Game and Method of Play

By way of example a half-inning of a player v. player game is described. FIG. 1 details the playing surface of the present invention. Each player will place their at-bat, half-inning, and game wagers prior to the first roll of the dice. The visiting team, determined by a roll of the dice or other suitable manner, will start the game with the dice. The player rolls the three dice and the total is 15. A review of the playing surface, namely a table of baseball outcomes, reveals the number 15 corresponds to a double. The dealers place a game piece on second base of the baseball diamond, pay winning wagers, collect losing wagers and the players place their new at-bat wagers. The player rolls the three dice again and the total is 9. A review of the outcome table reveals the number 9 corresponds to an out, via a strikeout, with the runner not advancing. The dealers place a game piece on the area indicating one out, pay the winning wagers, collect losing wagers and the players place their new at-bat wagers. The third roll of the dice total 5. A review of the outcome table reveals the number 5 corresponds to a groundout with a base runner advancing one base if less than two outs. The dealers move one game piece from second base to third base, the other game piece from one out to two outs, pay winning wagers, collect losing wagers and the players place their at-bat wagers. The fourth roll of the dice total 17. A review of the outcome table reveals the number 17 corresponds to an error with the batter to first base and further reveals that any base runners advance one base. Therefore, the runner on third base scores and the visiting team leads the game 1–0. The dealers remove the game piece from third base to one run (the runner scored) and move one game piece to first base, pay winning wagers, collect losing wagers and the players place their new at-bat wagers. The fifth roll of the dice total 10. A review of the outcome table reveals the number 10 corresponds to a pop-out. The dealers remove the game pieces from the bases, place a game piece on three outs, pay winning at-bat and half-inning wagers and collect losing wagers. The dice are now transferred to the opposing player for his rolls or at-bats and the players place their new at-bat and half-innings wagers.

In a team v. team game one player may roll for one at-bat and the dice may be passed successively until three outs occur and the dice revert to the opposing team. In another embodiment, one player can roll the dice for a team's half-inning and a second player can roll the dice for the team's second half-inning and so on. Each player involved in a team v. team game places his own individual wagers as desired.

In a player v. house game the player rolls for his team's at-bats and a dealer may roll for the house. In another embodiment, the player rolls for both himself and the house in a player v. house game.

The procedures described are repeated until nine innings are complete or until one team wins in extra innings. The odds of a specific outcome, based on the roll of the three dice, are closely related to the outcomes present in a live Major League Baseball® game. The payout tables, as always, reflect the optimum house advantage to render the game attractive to both the player and the house.

DESCRIPTION OF THE EMBODIMENTS

Figure 1:
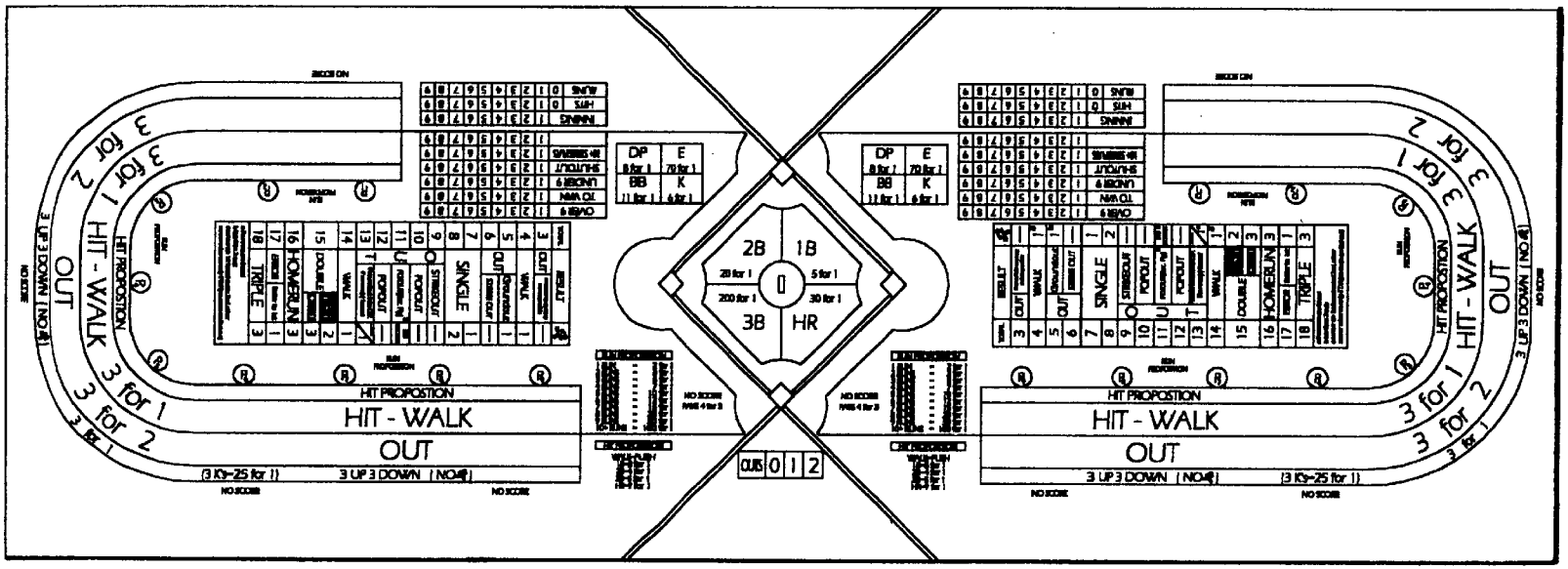
FIG. 1 is a close-up top view of one end a playing surface of the present invention.
Figure 2:
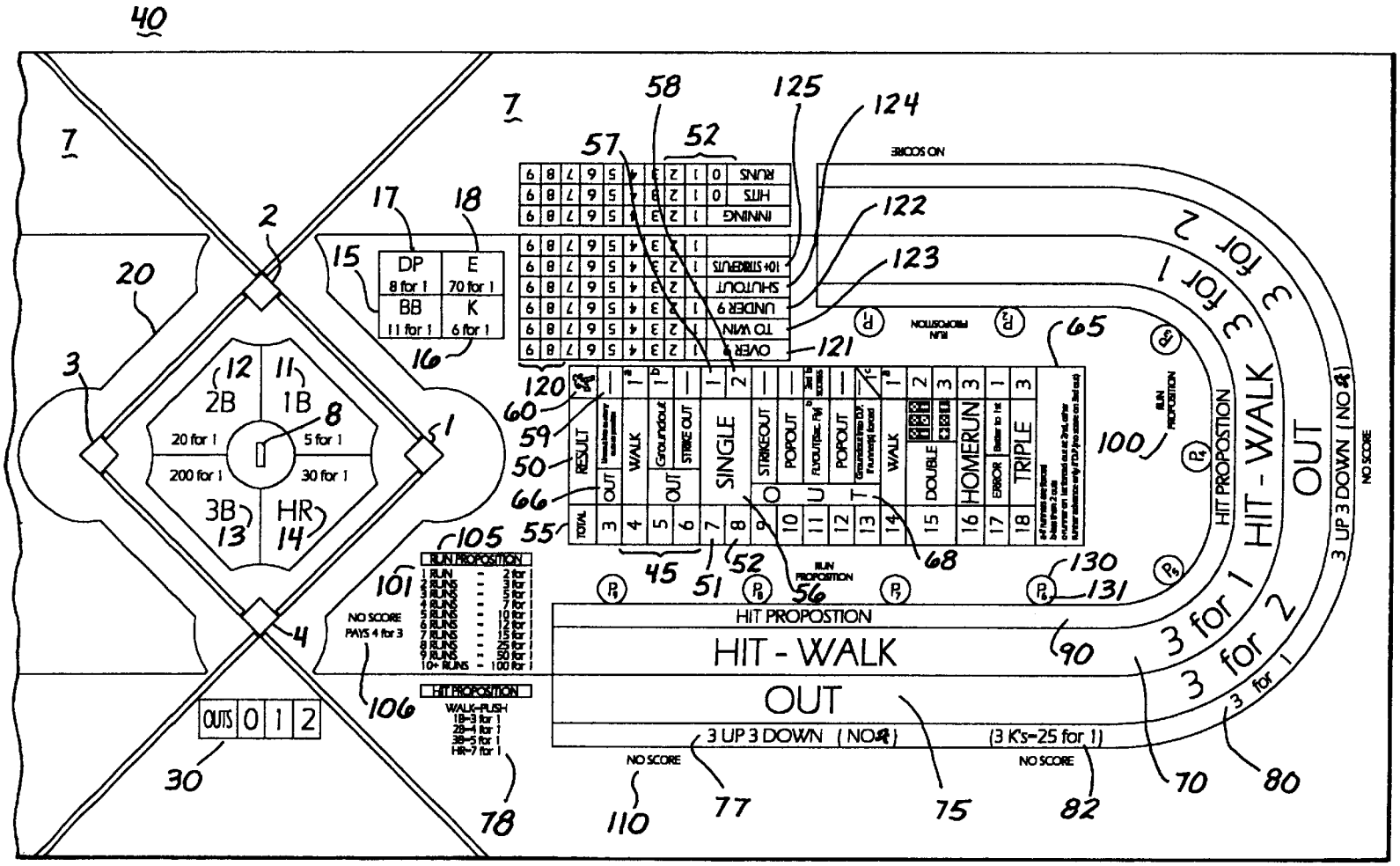
FIG. 2 is a top view illustrating the entire playing surface of the present invention.
Figure 3:
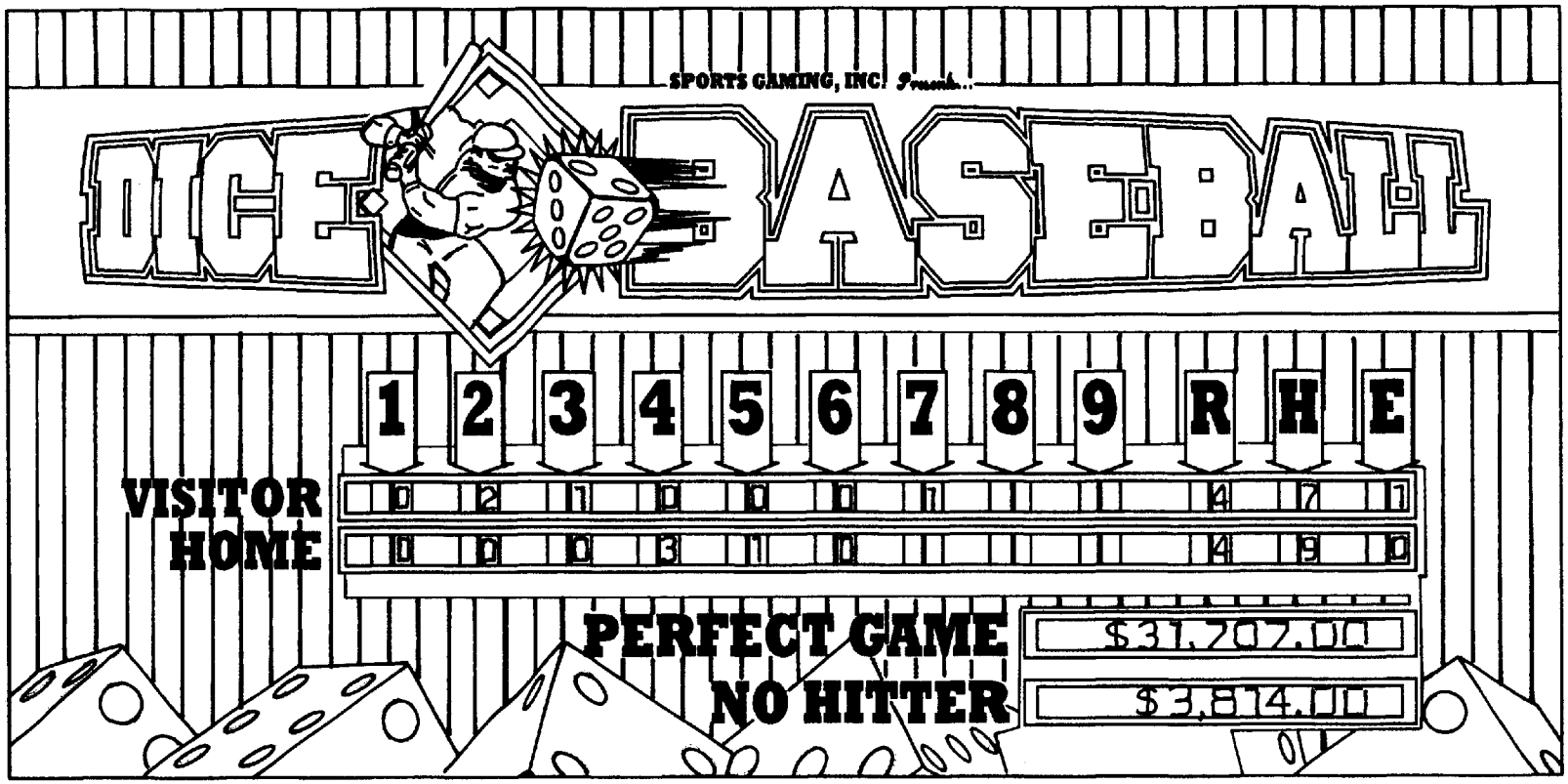
FIG. 3 is view of an overhead scoreboard of the present invention.

Reference is now made to the figures wherein like parts are referred to by like numerals throughout. FIGS. 1 and 2 show the playing surface of the present invention including marked portions which define the individual wagers, associated pay outs, roll outcomes and game status. The game described by the present invention is played on a table similar to a craps table including a pit and the game layout on the table's surface. FIG. 3 shows an overhead scoreboard.

As with a craps table, the game layout of the present invention is reproduced on both halves of the table's surface. Such an arrangement allows players on both ends of the table to easily follow the game status by referring to the proximate game layout. Casino employees, known as stickmen and boxmen, are stationed adjacent the table to facilitate payment of wagers, movement of game indicia and encouragement of additional wagers, namely those wagers providing the house with its greatest odds. Game indicia (not shown) may include round buttons depicting baseball themes to track game status including location of base runners, outs, inning of play, etc. However, the game indicia may take an infinite number of forms while serving the same function. It is further envisioned that the casino employees directing the game will use baseball terminology, such as "play ball" to initiate the game, "batter up" to initiate an at-bat, and "three up and three down" to signify the end of a half-inning, to enhance the baseball atmosphere surrounding the game.

Referring to FIGS. 1 and 2, the center of the game layout depicts a baseball diamond 20 including four bases 1, 2, 3, and 4 a pitcher's mound 5, an infield 6 and an outfield 7. For realism, green colors are used to signify grass, brown colors are used to signify dirt and white colors are used to signify bases 1, 2, 3 and 4, the pitcher's rubber 8 and foul lines 9. During play of the game, two bases 1, 3 will alternate as home plate and second base dependent on the player or team at bat. Home plate will be depicted as the base nearest the end of the table occupied by the offensive player or team. Therefore, the offensive team or player will roll the dice into the outfield 7 of their designated playing field. Casino employees operating the game will be responsible for alternating the two bases 1, 3 accordingly.

An outs chart 30 is located adjacent the baseball diamond 20 near a position 35 occupied by a casino employee referred to as a stickman. Said stickman will track game status by placing a game indicia on each number corresponding to the number of outs. The stickman is also in charge of retrieving the dice, placing certain wagers for players, presenting said dice to a next roller and regulating the pace of the game.

A boxman will occupy position 40 opposite the stickman's position 35. The boxman will check the dice, act as the ultimate arbitrator of disputes and serve as the official scorekeeper. A keyboard (not shown) will enable the boxman to enter runs, hits and errors per half inning for the line score displayed on an electronic scoreboard 41. The boxman may also track the players participating in progressive wagers or such tracking may be done with chip intake units known in the art. Finally, the boxman will record manually or enter and store via a computer processor the results of each and every at-bat to insure accuracy and proper dispute resolution.

An outcome chart 45 includes a result column 50 for each combination of a roll of three dice. For example, a combined roll of seven 51 or eight 52 in the dice column 55 results in a single 56 for the batter or roller. The outcome chart 45 further includes a base runner column 60 that details the movement of base runners during a particular outcome. For example, a combined roll of seven 51 is a single 56 with base runners advancing one base as depicted by the numeral one 57 in column 60 but a roll of eight 52 is a single 51 with the base runners advancing two bases as depicted by the numeral two 58 in column 60. A horizontal line 59 in column 60 denotes no base runner advancement.

The outcome chart 45 further includes additional explanations in both the result column 50 and footnotes 65 referred to in base runner column 60. For example, a combined roll of three (each dice displaying a single dot on its upper surface) results in an out 66 as denoted in the result column 50 and further results in a double or triple play depending on the number of base runners and number of outs as further denoted by "lineout into as many outs as possible" in the result column 50. By way of further example, a combined roll of eleven results in an out 68 as denoted in the result column 50 and further results in a "(Sac. Fly)" should a base runner be on third base as denoted in the base runner column 60 and there are less than two outs as explained in the referred to footnote.

At-Bat Wagers

Running parallel to the perimeter of the table are a hit-walk wagering section 70 and an out wagering section 75. The layout of the wagering sections 70, 75 is similar to the pass line and don't pass line associated with a traditional craps table layout. The hit-walk wagering section 70 and the out wagering section 75 are at-bat wagers placed prior to each player at-bat. The odds, namely 3 or 1 and 3 for 2 associated with each the hit-walk and the out wager respectively, are denoted in the wagering sections. The hit-walk wager and out wager pay the player based on the outcome of the roll immediately after the wager is placed. Any hit or a walk results in a payout according to the hit-walk wager and any out results in a payout according to the out wager. In a preferred embodiment a combined roll of 17 corresponding to an error results in a loss for all hit-walk and out wagers. Therefore, a combined roll of 17 provides the house or operator with a sweep of all hit-walk and out wagers.

Other at-bat wagers are available for the players of the game. Included within the baseball diamond 20 are wagering sections 11, 12, 13 and 14 displaying 1B (commonly known as a single), 2B (commonly known as a double), 3B (commonly known as a triple) and HR (commonly known as home run) respectively. Similarly, located adjacent the baseball diamond are wagering sections 15, 16, 17, 18 displaying BB (commonly known as a walk or base on balls), K (commonly known as a strikeout), DP (commonly known as a double play) and E (commonly known as an error). Players can wager that the next at-bat will yield a single, double, triple, home run, walk, strikeout, double play or error. Akin to betting any seven, the Big 6 or the Big 8 in craps, the odds associated with these at-bat wagers will significantly favor the house but will nonetheless attract bountiful wagers. These at-bat wagers will attract wagers regardless of the poor player odds since the result is instantaneous (e.g. one roll of the dice).

Running parallel to the hit-walk wagering section 70 is a hit proposition wagering section 90. Unlike wagering sections 11–18 which require the player to bet on a specific outcome of the next roll, the hit proposition wager operates to pay the player if the next roll results in any hit including a single, double, triple or home run. Therefore, four outcomes result in the player being paid on the single wager. In the preferred embodiment a walk results in a push with the house. A hit proposition odds table 78 is displayed adjacent the baseball diamond 20.

Half-Inning Wagers

Running parallel and adjacent the out wagering section 75 is a "3 up 3 down" wagering section 77. "3 up 3 down" is a baseball term referring to the appearance of three batters only in a half-inning of a baseball game. In other words, the player is wagering that only three batters will appear in the upcoming half-inning. An odds table 80 displaying the odds associated with the "3 up 3 down" wager is depicted adjacent the baseball diamond 20. First odds 80 of 3 for 1 are paid to the player in the event of any "3 up 3 down" occurrence including less than three strikeouts. Second odds 81 of 25 for 1 are paid to the player in the event the "3 up 3 down" occurs by means of three strikeouts (commonly referred to as "K's"). Therefore, the player will be paid 25 for 1 in the event the half-inning consists of three consecutive combined rolls of either six or nine denoted as strikeouts in the outcome chart 45.

Running parallel and adjacent the hit proposition wagering section 90 is a run proposition wagering section 100. The run proposition wager is a half-inning wager. The player making this wager is paid, according to the odds listed under the proposition column 101 of the run proposition table 105 displayed adjacent the baseball diamond 20, if the offensive team scores 1 or more runs during the next half-inning of play. A scoreless half-inning results in a lost wager. However, players can also wager that the half-inning will be scoreless by placing a wager in the no score wagering section 110 running parallel and adjacent the "3 up 3 down" wagering section 77. Adjacent the run proposition table 105 is an odds display 106 representing a wager on a scoreless inning. In the preferred embodiment the no score wager pays 4 for 3.

Game Wagers

Located adjacent the outcome chart 45 is a game wagering section 120 facing the game dealers. The wagers displayed in the game wagering section 120 are made by players prior to the start of the game and are paid based on the results of the game. Players can wager that the total game score will be over or under a predetermined score, that a particular team will win, that one team will be held scoreless or that one team will record more than a predetermined number of strikeouts. The game wagering section 120 is arranged such that a dealer places a wagering indicia on a player's designated number between 1 and 9 based on the player's position at the gaming table. The player's positions are more fully described in the progressive wagers section. In this manner, the dealer tracks the game wagers that have been placed and by whom they have been placed permitting the proper payout at the conclusion of a game.

In the preferred embodiment, the predetermined score related to over wagers 121 over and under wagers 122 is set at 10 based upon millions of computer generated games employing the three dice concept of the present invention. As further evidence of the realism of the present invention, over/under betting lines for Major League Baseball® games typically fall between 8 and 11. The over/under wagers 121, 122 pay the player even money. Similarly, players may place a win wager 123 resulting in an even money payout if the team wagered upon prevails. Players are also provided with a shutout wager 124 and a strikeout wager 125 based on a predetermined number of strikeouts. The shutout wager 124 results in a player payout of 20 for 1 should the opposing team be held scoreless. In the preferred embodiment the predetermined number of strikeouts is set at 10 based on Major League Baseball® statistics. Should a team record 10 or more strikeouts against the opposing team the player is paid 5 for 1.

Displayed immediately below the game wagering section 120 is an inning, runs and hits chart 25 facing the dealer. Utilizing the chart 25, the dealer tracks the inning, runs and hits during play of the game. As previously disclosed, the stickman utilizes chart 30 to track outs.

Progressive Wagers

Casinos have attracted gamblers by means of progressive jackpots. Progressive jackpots increase over time until some predetermined event occurs and a gambler wins a substantial prize. The predetermined event is typically extremely rare, such as being dealt a royal flush in five cards, to build a large jackpot and increase the gambler's interest. The present invention includes a progressive wager based on two rare baseball occurrences: a no-hitter or a perfect game. A no-hitter, as it implies, is accomplished when one team fails to get a hit for the entire game. The perfect game is accomplished when one team sends only 27 batters to the plate during a nine inning game and none of the players reach base. The player is paid the progressive only if the player is wagering with the winning team. Therefore, players, who participate, for the team that pitches the perfect game or no-hitter each receive the jackpot but the opposing team players receive no progressive jackpot. Progressive jackpot totals are prominently displayed on the overhead scoreboard 41

Corresponding to a player location along the gaming table is a progressive wagering section 130 displayed as a circle with a player number 131 enclosed therein. Nine player locations are available on each end of the gaming table corresponding to nine baseball players per team. Player number 131 is also used by dealers to identify players within the game wagering section 120. The player places the progressive wager by placing a chip, cheque, cash, token or the like in the progressive wagering section 130. In the preferred embodiment the player must wager $1 to participate in the progressive wager. The progressive jackpot for the perfect game will begin at $25,000 and increase based on a percentage of the progressive wagers accepted as more fully disclosed below. In a similar fashion the no-hitter progressive jackpot will begin at $2,500 and increase based on a percentage of the progressive wagers accepted. In a preferred embodiment 4% of the progressive wagers are set aside for the no-hitter wager and 1% of the progressive wagers are set aside for the perfect game wager. Players participating in the progressive wagers may each win the total jackpot displayed or share the displayed total in a prorated manner depending on the operator of the game. The odds are such that each method may benefit the game operator.

Parlay Wagers

Parlay wagers are offered with sports wagering and require the gambler to win more than one outcome but provides increased pay outs to the gambler. The present invention provides parlay wagers to re-create the wagers permitted on live sporting events. Therefore, players are permitted to wager that a team or player will both win and the total score will be over or under the predetermined total. Therefore, the player will be placing a win wager 123 and an over/under wager 121, 122. In order to win the wager the player must win each wager. While the actual odds of prevailing on two separate 50—50 wagers is 1 in 4, a two team parlay typically pays 13 to 5 or 14 to 5 providing the house with a premium edge. The present invention contemplates a 14 to 5 premium payout since the over/under wager is not precisely 50—50 and to further attract sports gamblers.

In a similar vein, players are allowed to wager on the occurrence of both a shutout and a number of strikeouts above a predetermined number. Like a parlay wager, this wager requires the player to prevail on both wagers in order to be paid. However, since the inherent odds of pitching a shutout are must less than a 50—50 wager and the odds of striking out more than 10 batters is much less than a 50—50 wager the player receives a generous payout of 100 for 1. Of course, the house continues to enjoy a large edge over the true odds associated with such an occurrence.

Other wagers are envisioned and include wagers on the occurrence of one or more of the following: triple plays, grand slams, bases loaded triple, exact number of runs, hits or strikeouts. In fact, a game as intricate as baseball affords the casino or operator an infinite number of different wagers to attract players.

In a preferred embodiment, the possible outcomes and related probabilities are defined as set forth in Table A. Table B illustrates the preferred pay outs for each wager and the related house edge. The game is not confined to or defined by the illustrated odds/pay-offs. The game can be played by offering pay outs of a higher or lower order. In fact, the game of the present invention can be played as a pure means of entertainment without the wagering aspect. However, in the preferred embodiment wagering is integral to the operation of the present invention.

TABLE A

| SUM OF DICE | NUMBER OF WINS | PROBABILITY OF OCCURRENCE |
|---|---|---|
| 3 | 1 way | .004630 |
| 4 | 3 ways | .013889 |
| 5 | 6 ways | .027778 |
| 6 | 10 ways | .046292 |
| 7 | 15 ways | .069444 |
| 8 | 21 ways | .097222 |
| 9 | 25 ways | .115740 |
| 10 | 27 ways | .125000 |
| 11 | 27 ways | .125000 |
| 12 | 25 ways | .115740 |
| 13 | 21 ways | .097222 |
| 14 | 15 ways | .069444 |
| 15 | 10 ways | .046292 |
| 16 | 6 ways | .027778 |
| 17 | 3 ways | .013889 |
| 18 | 1 way | .004630 |

TABLE B

| AT-BAT WAGERS | PAYOUT | HOUSE EDGE |
|---|---|---|
| Hit-Walk | 3 For 1 | 1.39% |
| Out | 3 For 2 | 1.39% |
| Hit Proposition: | | 1.39% (overall) |
| Walk | Push | |
| Single | 3 For 1 | |
| Double | 4 For 1 | |
| Triple | 5 For 1 | |
| Home Run | 7 For 1 | |
| Home Run | 30 To 1 | 13.9% |
| Triple | 200 To 1 | 6.9% |
| Double | 20 For 1 | 7.4% |
| Single | 5 For 1 | 16.7% |
| Walk | 11 For 1 | 8.3% |
| Strikeout | 6 For 1 | 7.8% |
| Error | 70 For 1 | 2.8% |
| Double Play | 8 For 1 | 7.7% |
| **HALF-INNING WAGERS** | **PAYOUT** | **HOUSE EDGE** |
| 3 Up 3 Down | | 6.9% (overall) |
| Any Outs | 5 For 2 | |
| All Strikeouts | 25 For 1 | |
| No Score | 4 For 3 | 4.0% |
| Run Proposition | | 2.64% (overall) |
| 1 Run | 2 For 1 | |
| 2 Runs | 3 For 1 | |
| 3 Runs | 5 For 1 | |
| 4 Runs | 7 For 1 | |
| 5 Runs | 10 For 1 | |
| 6 Runs | 12 For 1 | |
| 7 Runs | 15 For 1 | |
| 8 Runs | 25 For 1 | |
| 9 Runs | 50 For 1 | |
| 10+ Runs | 100 For 1 | |
| **GAME WAGERS** | **PAYOUT** | **HOUSE EDGE** |
| Team to Win | 2 For 1 | 0.00% |
| To realize a house edge the house may charge a 5%–10% commission similar to that associated with live sports wagering. | | |
| Over 10 Runs | 2 For 1 | 6.8% |
| Under 10 Runs | 2 For 1 | 7.2% |
| Game Into Extra Innings | 10 For 1 | 5.7% |
| Progressive No-Hitter/Perfect Game | $2,500+/ $25,000+ | 5.4% (based on 4% of progressive wagers earmarked for no-hitter and 1% for perfect game) |
| Shutout | 18 To 1 | 3.4% |
| 10+ Strikeouts | 10 For 1 | 4.3% |
| Shutout & 10+ Strikeouts | 200 For 1 | 2.44% |

It is envisioned that the game described herein can be implemented in an electronic format as well. In such an embodiment, a player will play the game according to the same rules and pay outs but said game will be on a video display similar to video poker or video keno. Said electronic game will be controlled by a computer, including a microprocessor, memory and interfaces, as known in the art. In an electronic format, players will play against the computer or other players at linked gaming machines.

Although the invention has been described in detail with reference to a preferred embodiment, additional variations and modifications exist within the scope and spirit of the invention as described and defined in the following claims.

I claim:

1. A method for two teams, of one or more players each, to play one another in a casino dice game predicated on the game of baseball, including the steps of:

a. providing three dice each having six faces bearing a visual representation of the numbers one though six, the dice generating a plurality of single roll outcomes calculated by adding said number from each die wherein each single roll outcome corresponds to a simulated baseball at-bat;

b. providing one or more wagering areas on a gaming table layout;

c. providing predetermined baseball related outcomes corresponding to each summation of the dice from 3 to 18, each baseball related outcome independent of any player decision;

d. providing predetermined payout values for said baseball outcomes; and e. providing means for tracking current status of said casino dice game.

2. The method according to claim 1 wherein said means for tracking current status of said casino dice game includes a depiction of a baseball diamond on said gaming table layout and gaming indicia used thereon to simulate base runners.

3. The method according to claim 1 wherein said means for tracking current status include areas displayed on said gaming table layout for tracking outs, runs, hits and inning number and gaming indicia used thereon to signify the status.

4. The method according to claim 1 wherein said wagering areas include a hit-walk wager decided by each roll of the dice.

5. The method according to claim 1 wherein said wagering areas include an out wager decided by each roll of the dice.

6. The method according to claim 1 wherein said wagering areas include a hit-proposition wager decided by each roll of the dice.

7. The method according to claim 1 wherein said wagering areas include a home run wager decided by each roll of the dice.

8. The method according to claim 1 wherein said wagering areas include a triple wager decided by each roll of the dice.

9. The method according to claim 1 wherein said wagering areas include a double wager decided by each roll of the dice.

10. The method according to claim 1 wherein said wagering areas include a single wager decided by each roll of the dice.

11. The method according to claim 1 wherein said wagering areas include a walk wager decided by each roll of the dice.

12. The method according to claim 1 wherein said wagering areas include a strikeout wager decided by each roll of the dice.

13. The method according to claim 1 wherein said wagering areas include an error wager decided by each roll of the dice.

14. The method according to claim 1 wherein said wagering areas include a double-play wager, contingent upon a base runner being located on first base, said double-play wager decided by each roll of the dice thereafter as long as a base runner remains on first base.

15. The method according to claim 1 wherein a gaming session continues for a simulated nine innings of play.

16. The method according to claim 15 wherein a tie score at the end of nine innings results in play of extra innings until a team wins.

17. The method according to claim 1 wherein one or more said wagering areas include half-inning wagers decided by results of each half-inning of simulated play.

18. The method according to claim 17 wherein said half-inning wagers include a "3 up 3 down" wager.

19. The method according to claim 18 wherein said "3 up 3 down" wager pays increased odds in the event said "3 up 3 down" is accomplished by means of three consecutive strikeouts.

20. The method according to claim 17 wherein said half-inning wagers include a no score wager.

21. The method according to claim 17 wherein said half-inning wagers include a run proposition wager.

22. The method according to claim 1 wherein one or more said wagering areas include game wagers decided by results of a game of simulated play.

23. The method according to claim 22 wherein said game wagers include a team to win wager.

24. The method according to claim 23 wherein a game operator charges a commission on said team to win wager.

25. The method according to claim 24 wherein said commission is from 5% to 10% of said amount of team to win wager.

26. The method according to claim 22 wherein said game wagers include an over/under 10 runs wager.

27. The method according to claim 22 wherein said game wagers include a game into extra innings wager.

28. The method according to claim 22 wherein said game wagers include a shutout wager.

29. The method according to claim 22 wherein said game wagers include a 10 or more strikeouts wager.

30. The method according to claim 22 wherein said game wagers include parlay wagers requiring a player to win two or more combined wagers to receive a pay out.

31. The method according to claim 30 wherein said parlay wager requires a player to win both a shutout wager and a ten or more strikeouts wager to win said parlay wager.

32. The method according to claim 22 wherein said game wagers further include one or more progressive jackpot wagers.

33. The method according to claim 22 wherein said progressive jackpot is paid to participating winning team members wherein said team pitches a simulated no-hitter.

34. The method according to claim 32 wherein said progressive jackpot is paid to participating winning team members wherein said team pitches a simulated perfect game.

35. The method according to claim 1 wherein said predetermined baseball related outcomes corresponding to each summation of the dice from 3 to 18 are displayed on said gaming table layout.

36. The method according to claim 1 further including an area displayed on said gaming table layout for recording game wagers by a player number.

37. The method according to claim 36 wherein said player number corresponds to a player's position around said gaming table layout.

38. The method according to claim 1 wherein said predetermined pay out values for said baseball outcomes are displayed on said gaming table layout.

39. The method according to claim 1 wherein said depicted baseball diamond includes wagering areas depicted on an infield section corresponding to single, double, triple and home run wagers decided by each roll of the dice.

40. The method according to claim 1 wherein said team players, in turn, sequentially roll the dice corresponding to each at-bat.

41. The method according to claim 1 wherein said team players, in turn, sequentially roll the dice corresponding to a half-inning of simulated play.

42. The method according to claim 1 wherein a single identical player comprises each team.

43. The method according to claim 1 wherein a game's operators comprise one team.

44. The method according to claim 1 wherein said game status is displayed on an electronic scoreboard.

45. The method according to claim 44 wherein said game status includes inning, runs, hits, errors and score.

46. The method according to claim 1 wherein steps (a) through (e) are provided by a microprocessor and a player plays a simulated game by means of a display on an electronic video screen.

47. The method according to claim 46 and wherein a player plays a simulated game against said microprocessor.

48. A casino dice game predicated on the game of baseball including:

a. three or more dice having six faces bearing a visual representation of the numbers one though six, the dice generating a plurality of single roll game outcomes calculated by adding said number from each die wherein each single roll game outcome corresponds to a simulated baseball at-bat;

b. one or more wagering areas on a gaming table layout;

c. predetermined baseball related outcomes corresponding to each summation of the dice, each baseball related outcome independent of any player decision;;

d. predetermined pay out values for said baseball outcomes; and e. means for tracking current status of said casino dice game.

49. The casino dice game according to claim 48 wherein said game is played by two opposing teams.

50. The casino game according to claim 49 wherein said teams are comprised of a single identical player.

51. The casino game according to claim 49 wherein a game's operators comprise one team.

52. The casino game according to claim 48 wherein said game status is displayed on an electronic scoreboard.

53. The casino game according to claim 52 wherein said game status includes inning, runs, hits, errors and score.

54. The method according to claim 48 wherein steps (a) through (e) are provided by a microprocessor and a player plays a simulated game by means of a display on an electronic video screen.

55. The method according to claim 54 and wherein a player plays a simulated game against said microprocessor.

56. A dice game predicated on the game of baseball including:

a. three or more dice having six faces bearing a visual representation of the numbers one though six, the dice generating a plurality of single roll outcomes calculated by adding said number from each die wherein each single roll outcome corresponds to a simulated baseball at-bat;

b. predetermined baseball related outcomes corresponding to each summation of the dice, each baseball related outcome independent of any player decision;; and c. means for tracking current status of said casino dice game.

57. The dice game according to claim 56 wherein said game is played by two opposing teams.

58. The game according to claim 57 wherein said teams are comprised of a single identical player.

59. The game according to claim 56 further including a means of wagering on the predetermined baseball related outcomes corresponding to each summation of the dice.

60. The game according to claim 56 further including a means of tracking current status of a game.

61. The method according to claim 56 wherein elements (a) through (c) are provided by a microprocessor and a player plays a simulated game by means of a display on an electronic video screen.

62. The method according to claim 61 and wherein a player plays a simulated game against said microprocessor.

* * * * *